US006146131A

United States Patent [19]

Wiseman

[11] Patent Number: 6,146,131

[45] **Date of Patent: *Nov. 14, 2000**

[54] ENCLOSED GROUND-FLARE INCINERATOR

[75] Inventor: Thomas R. Wiseman, Calgary, Canada

[73] Assignee: Rana Development, Inc., Calgary, Canada

[ * ] Notice: This patent is subject to a terminal disclaimer.

[21] Appl. No.: 09/439,260

[22] Filed: Nov. 11, 1999

Related U.S. Application Data

[63] Continuation-in-part of application No. 09/344,259, Jun. 26, 1999, Pat. No. 6,012,917.

[51] Int. Cl.[7] ..... F23D 13/24

[52] U.S. Cl. ..... 431/202; 431/5; 431/154; 431/351

[58] Field of Search ..... 431/518, 202, 431/154, 180, 174, 185, 350–353, 285

[56] References Cited

U.S. PATENT DOCUMENTS

| | | | |
|---|---|---|---|
| 4,140,471 | 2/1979 | Straitz et al. | 431/5 |
| 4,652,233 | 3/1987 | Hamazaki et al. | 421/202 |
| 4,975,042 | 12/1990 | Schwartz et al. | 435/5 |
| 6,012,917 | 1/2000 | Wiseman | 431/202 |

OTHER PUBLICATIONS

"Waste Gas Incinerators", Bradon Industries, Ltd., Calgary, Alberta, Canada, Current Internet Posting—URL:www.bradon.com.

"Waste Gas Quiet Burn Thermal Destruction Units", Tornado Flare Systems, Current Internet Posting—URL:www-tornadoflare.com.

*Primary Examiner*—James C. Yeung
*Attorney, Agent, or Firm*—Sheridan Ross P.C.

[57] ABSTRACT

An improved ground flare is provided comprising a stack, two or more burner assemblies, and a servicing port so that some of the burner assemblies can be serviced while others remain in operation. The burner assemblies comprise a burner conduit and nozzles which are individually fitted to the stack's burner chamber and are each removably supported in the chamber. Preferably, the lower end of the stack is formed of one or more axially displaced lower tubular shells which are concentrically spaced for forming annular inlets for admitting additional combustion air. More preferably, an upper tubular exhaust stack, similarly formed, admits additional combustion air: for providing secondary combustion air for increasing the efficiency of combustion from the burner assemblies; for increasing the flow of exhaust gases for improved discharge momentum and atmospheric dispersion; and for cooling the upper stack. Additionally, the additional air permits the addition of auxiliary burners above the annular spaces wherein additional air supplies the necessary primary combustion air, enabling greater waste gas combustion throughput.

7 Claims, 5 Drawing Sheets

ENCLOSED GROUND-FLARE INCINERATOR

CROSS REFERENCE TO RELATED APPLICATION

This application is a continuation-in-part of pending U.S. patent application Ser. No. 09/344,259, filed Jun. 26, 1999, U.S. Pat. No. 6,012,917.

FIELD OF THE INVENTION

The invention relates to improvements to ground flare stacks for burning waste combustible gases generally, and specifically to apparatus enabling changing of a burner while the flare continues to operate on other burners while also improving combustion.

BACKGROUND OF THE INVENTION

Ground flares and incinerators are being used more frequently as they are typically more environmentally efficient. Regulations are being tightened with emissions resulting from flaring, venting of tank vapors and venting of BTEX emissions (benzene, toluene, ethylbenzene and xylene) from the glycol dehydrators on natural gas wells.

Waste gases from the wellsite and gas treatment facilities are incinerated in ground flares at high temperature to ensure that complete combustion takes place. The majority of the combustion takes place within the burning chamber and the stack and, unlike open flares, there is usually no visible flame outside the stack. A ground flare burns its fuel in a chamber in the flare stack and, as a result, combustion is more controlled. Oil and gas industry studies have shown that combustion efficiency drops significantly when combustion takes place outside the stack and worsens as outside wind increases. U.S. Pat. No. 4,652,233 to Hamazaki utilizes a conventional burner extending into the combustion chamber and emphasizes the wind proofing of the stack to ensure efficient combustion.

As is the case when waste gases, having fluctuating quality, are burned, the burners sometimes need to be serviced or changed out to a style or size appropriate to the quality and quantity of gas presently being combusted. With the conventional burner systems, the burners cannot be changed while waste gas continues to be burned; instead the facility must be shut in or re-routed to other equipment during servicing.

Usually ground flares do not use forced air, relying on induced draft to supply combustion gases. The burners typically utilize a gas header with upwardly extending nozzles for atomization of the waste gas upwardly into the combustion chamber. While it is known to remove one of multiple forced air burners from furnaces without interrupting operation, it is not known to remove a gas header bearing nozzles from a ground flare stack. The vertically oriented nozzles significantly encumber the horizontal in-stack gas header and complicate its removal therefrom.

The apparatus disclosed by Hamazaki is complicated, as is the apparatus of other ground flares known to the applicant and they do not disclose means for dealing with the need to change a burner on the fly.

While there are numerous incinerators in use currently, the inventor is not aware of any in which the system can be serviced or the burners replaced without the facility owner having to shut down operations and suffering economic losses associated therewith.

In another aspect of flare design, the height of stacks generally are often dictated by the results of environmental plume calculations. Conventional flares with external mix result in low flow discharge and must have high stacks to provided sufficient exhaust dispersion. Ground flares and incinerators are typically much shorter than conventional flare stacks and are subject to these plume or dispersion controls. Despite combustion occurring within the burn chamber of a ground flare, regulatory controls can require a ground flare to have a much greater height than is necessary only to satisfy the combustion requirement. Increased flare height results in an economic impact including the amount of material used and stack support.

Increased flow discharge from the flare positively affects the stack height requirements; the higher the discharge velocity or flow rate for a given stack size, the lower the stack height.

It is known, in the defense industry, to introduce cooling air to a stack through annular openings on exhaust stacks of ships-of-war for reducing their heat signature and thereby avoiding detection by heat-seeking missiles. The exhaust stacks were constructed of ever increasing diameter tubular shells which permitted additional ambient temperature air to co-flow with the hot exhaust, thereby cooling the exhaust stack. The ship's exhaust was fully combusted at that point and the incoming air aided only in the cooling of the stack.

In light of the above, it is a desirable characteristic to simplify the apparatus of ground flare stacks, improve combustion and to provide a highly dispersed exhaust from the flare stack without interfering with the operation of the burners.

SUMMARY OF THE INVENTION

An improved ground flare is provided having efficient combustion and a low stack height. The flare's stack has minimal internal components and the arrangement of the burner assemblies permit in-operation servicing of burners.

In a broad aspect, the stack comprises burner assemblies and a servicing port so that some of the assemblies can be serviced while others can remain in operation. More particularly, two or more burner assemblies are fitted to the burner chamber, each burner assembly comprising: a substantially horizontal burner conduit having one or more upwardly directed nozzles, the header having a gas inlet end and a closed end. The burner conduit is removably supported in the chamber by sandwiching between and inlet port at the inlet end and a closure port at the closed end. The inlet end of the burner conduit is sealably inserted into a socket in the inlet port so that the waste gases can be conducted therein. The closure port can be opened for physically releasing the burner conduit and supplying sufficient axial movement room for extracting the conduit from the socket, thereby releasing the conduit for hand removal through the servicing port.

More preferably, the novel burners are combined with an efficient and simple ground flare stack wherein the lower stack portion comprises one or more axially displaced lower tubular shells, each adjacently higher shell having a greater diameter, all of which are located below two or more burners fitted into a burn chamber. The lower shells are concentrically spaced, forming annular inlets for admitting combustion air. An upper tubular exhaust stack conducts the products of combustion up and away from the burn chamber.

Preferably, and aiding in minimizing its height, the tubular exhaust stack further comprises, one or more axially displaced tubular shells which are also concentrically spaced, each higher shell having a greater diameter than the preceding shell for forming annular inlets for admitting additional combustion air for additional mixing with the combustion already occurring. The additional air further increases the efficiency of combustion from the burners therebelow. The additional air further increases the flow of exhaust for improved atmospheric dispersion and for cooling the upper stack.

In another aspect of the invention, an improved flare stack is provided having a primary set of burners located in a burn chamber, and a series of axially spaced and concentric tubular shells positioned above the primary burner, therefore permitting the admission of additional air which not only provides secondary combustion air for the primary burners but also provides primary combustion air for one or more auxiliary burners, positioned in the stack above the primary burners amongst the tubular shells.

DETAILED DESCRIPTION OF THE PREFERRED EMBODIMENT

Figure 1:
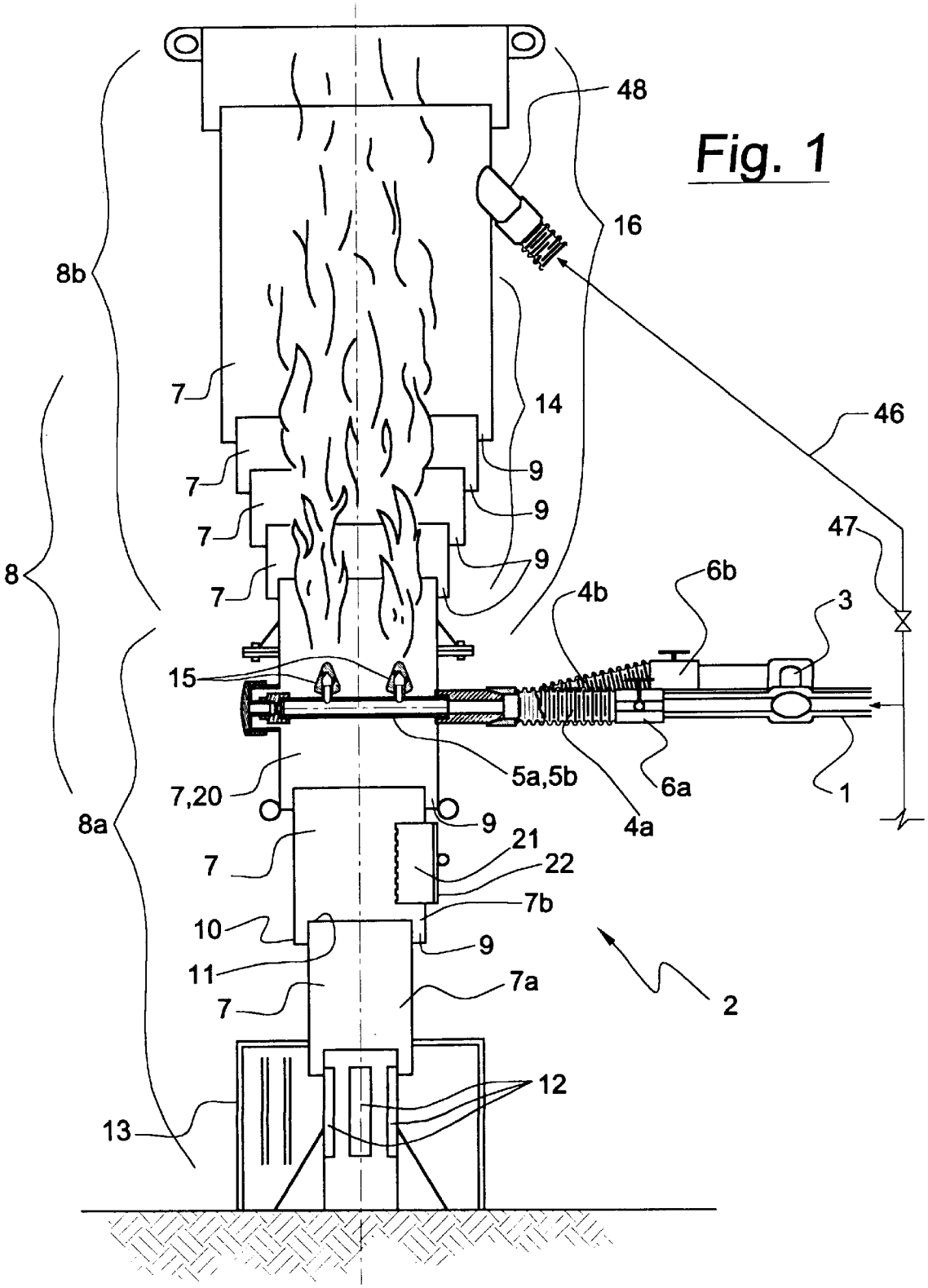
FIG. 1 is a side cross-sectional view of an improved ground flare stack which implements an embodiment of the present invention. Waste gas conduit and flow is shown in a schematic form.

Having reference to FIG. 1, waste gas is directed through gas conduit 1 to a ground flare 2. The gas conduit 1 forms a header 3 which splits into two or more burner feed lines 4*a*,4*b*. A first burner 4*a* feed line supplies a first burner 5*a* and the second feed line 4*b* supplies a second burner 5*b*. First and second valves 6*a*,6*b* permit selection and use of the first or the second burners 5*a*,5*b* respectively. Both burners can be selected simultaneously. The lines 4*a*,4*b* shown extending between the valves 6*a*,6*b* and the burners 5*a*,5*b* are flexible.

The present invention involves minimizing the overall flare height, maximizing combustion efficiency, and maximizing serviceability.

The Flare

The ground flare 2 comprises a stack 8 having a bottom portion 8*a* and an upper portion 8*b*. The bottom portion 8*a* is formed of one or more tubular shells 7,7.

Combustion air enters the system from several areas. First, air enters through a plurality of circumferentially spaced vents 12 cut into the stack's bottom portion 8*a*. The vents 12 are sized to ensure that sufficient air can be delivered in relation to the capacity of the nominal quantity of waste gas being fed. A windbreak 13 of various possible designs is provided around the vents 12 to direct air into the stack's bottom portion 8*a*, and not directly through.

In one embodiment, the stack's bottom portion is a single shell (not shown) and the only entry of air is through vents 12.

In the embodiment shown in FIG. 1, the stack's bottom portion 8*a* is formed of a plurality of concentric tubular shells 7, each shell 7*a*,7*b* . . . being displaced spaced axially. Each upwardly adjacent shell 7*b* has a greater diameter than the preceding shell 7*a* so that an annular space 9 is formed between adjacent shells 7*b*,7*a*. The lower edge 10 of the adjacently higher shell 7*b* overlaps the upper edge 11 of the lower shell 7*a*.

Figure 2:
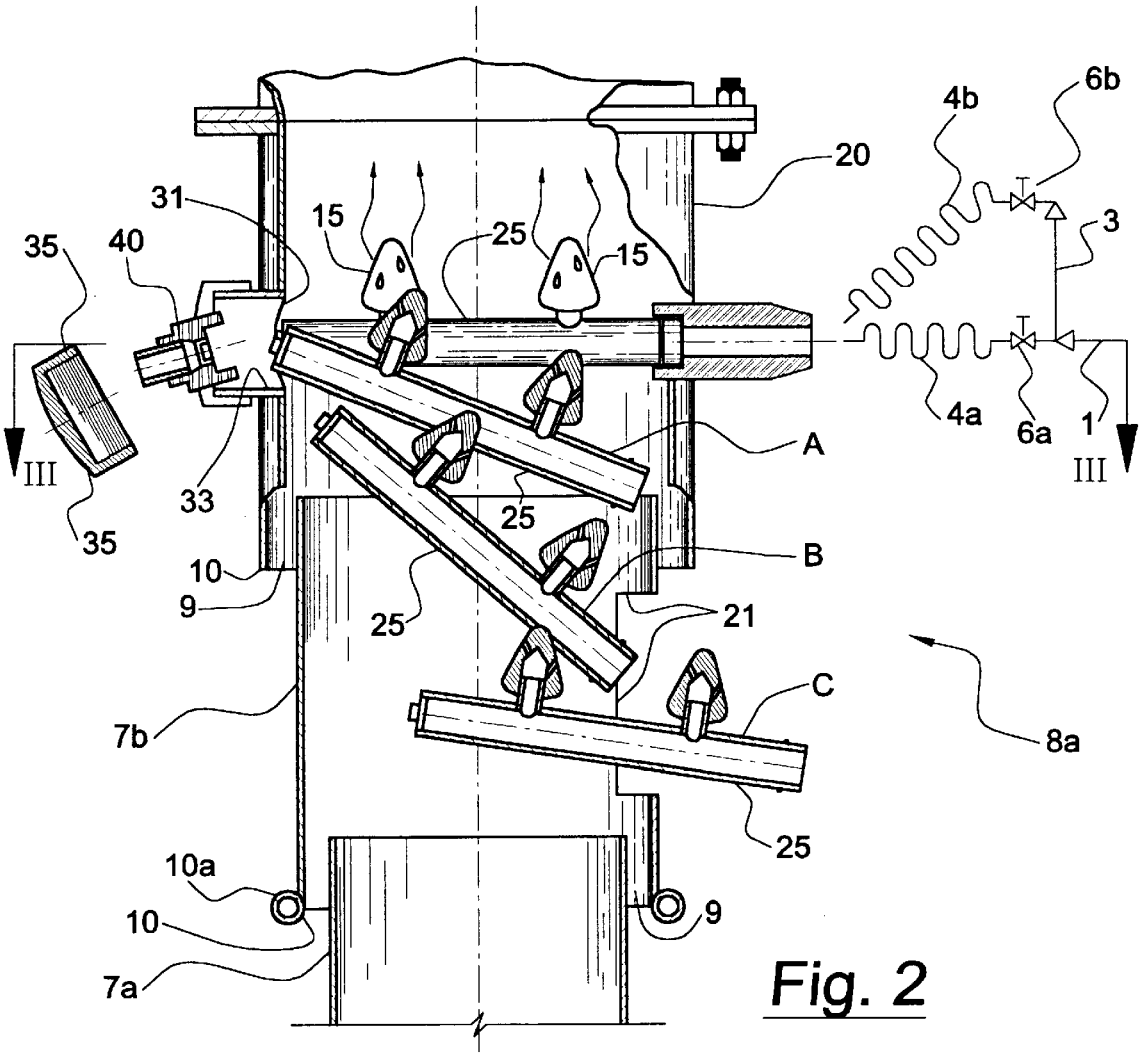
FIG. 2 is a partial cross-sectional view of the burner area according to FIG. 1. One of two burners is shown being manipulated in 3 stages A,B,C of removal through the servicing port.

Secondly, combustion air enters through the annular spaces 9 between the adjacent shells 7 of FIG. 1. The entry of annular air is optionally aided by modifying one or more of the lower edges 10 of the upper or bottom portion shells by adding a hoop 10*a* of circular cross-section (FIG. 2). The one or more hoops 10*a* act as a bell-mouth intake for smoothing the incoming secondary combustion annular air so as to result in an improved intake of secondary air.

This annular air is provided in several stages described below.

One or more of the shells 7 above the burners 5*a*,5*b* form a burn chamber 14. One or more nozzles 15 are fitted to the burners 5*a*,5*b* for distributing the waste gas in a manner suitable for most efficient combustion. The nozzles 15 ensure atomization of the waste gases and direct and discharge combustible waste gases upwardly into the burn chamber 14. Combustion air from the annular spaces 9 mix with the waste gases as they exit the nozzles 15. An exhaust stack 16 is fitted to the burner chamber 14 for removing products of combustion. Conventional pilot, ignition systems and flame sensors (not shown) initiate and monitor combustion above the burners 5*a*,5*b*.

The sizing of the nozzle 15 and burners 5*a*,5*b* and corresponding air flow from the vents 12 and annular spaces 9 are conventionally designed for matching the quantity of discharged gases and entrained air to complete the combustion within the burn chamber.

When the flare 2 is operation, a draft is created in the stack 8, drawing air upwardly and in through the vents 12 and annular spaces 9. At the lower end of the stack, generally below the burners, the vents 12 and the annular spaces 9 admit primary combustion air.

Annular spaces 9 above the burners admit secondary combustion air for burners 5*a*,5*b*; one, for improved efficiency of combustion, and secondly, for admitting volume-building air for improved dispersion and stack cooling.

The system may be clad with noise reduction materials (not shown) to reduce noise to meet industry regulations.

The Burners

The construction of the burners 5*a*,5*b* and their installation into the stack 8 enable on-the-fly servicing. Accordingly, two or more burners 5*a*,5*b* are provided so that one burner 5*b* can continue discharging waste gases while the other burner 5*a* is being serviced.

Figure 3:
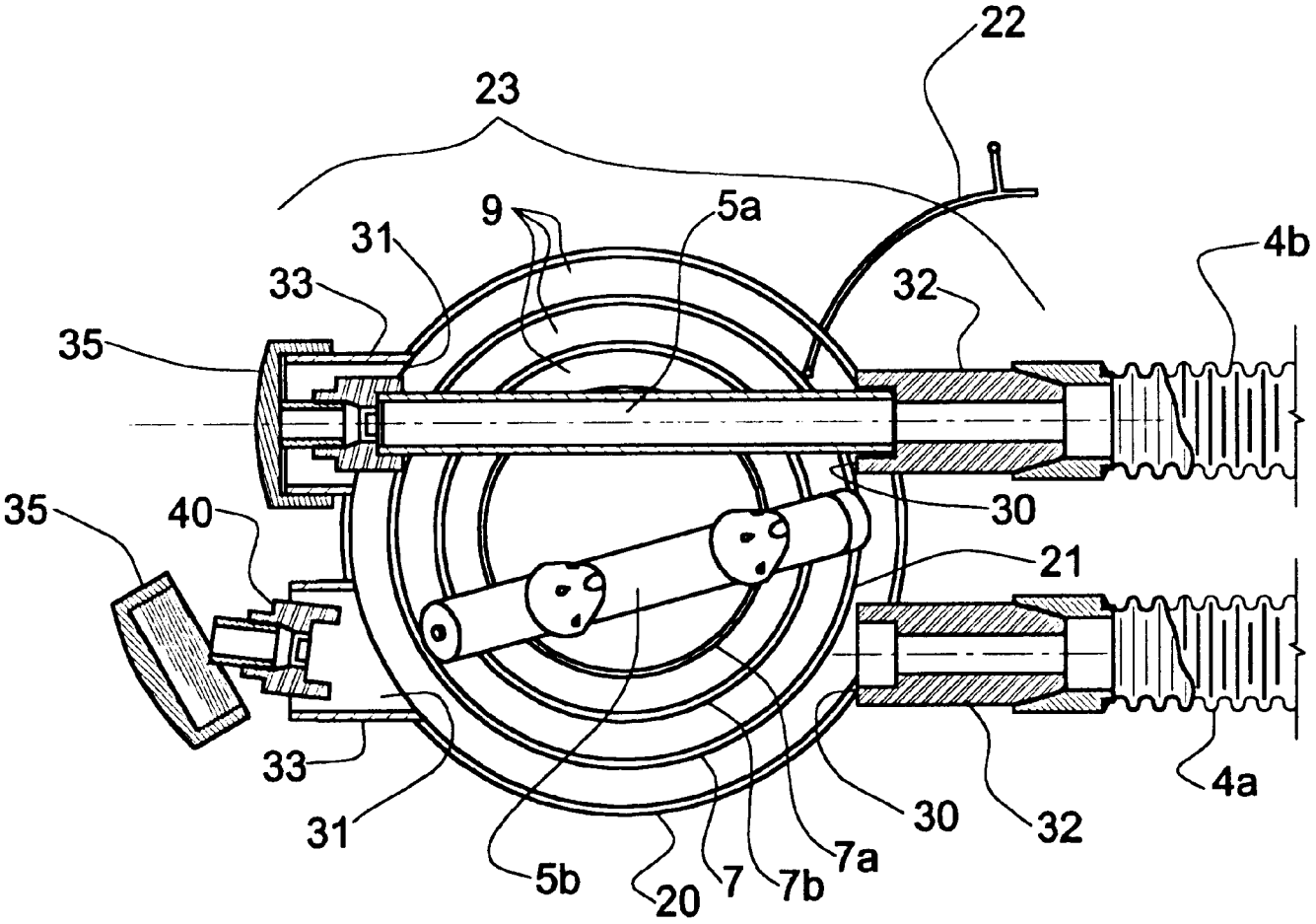
FIG. 3 is a cross-sectional downward view along line III—III of FIG. 2, showing two side-by-side burners, one of which is being removed, at corresponding stage A of FIG. 2.

Having reference to FIGS. 1 and 3, the two burners 5*a*,5*b* are shown in a laterally side-by-side arrangement and horizontally extending orientation.

The burners 5*a*,5*b* are supported and installed into a burner support shell 7,20. Each burner 5*a*,5*b* has a substantially identical set of components.

A burner service port 21 is provided at the same elevation or below the burners, illustrated in FIGS. 1 and 2 as being located in the next lower shell 7*b* under the burner shell 20. The port 21 has an access door 20 sized to permit a burner 5*a*,5*b*, including nozzles to be passed therethrough.

Figure 4:
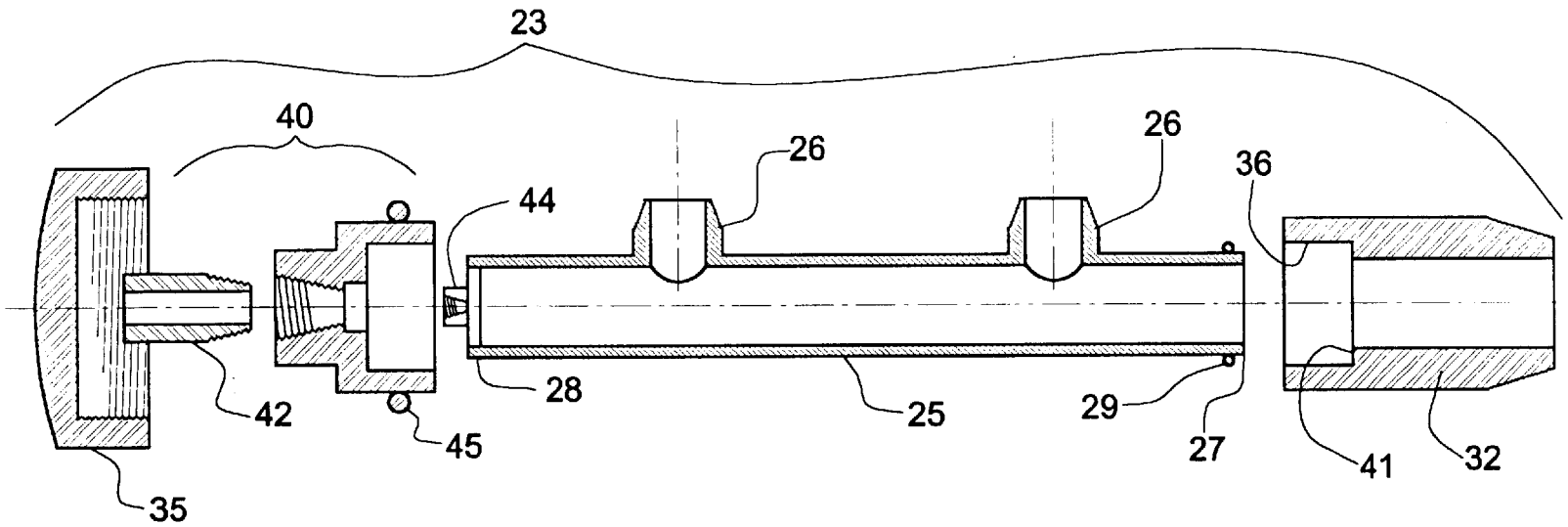
FIG. 4 is an exploded cross-sectional side view of one burner assembly.

Best shown in FIGS. 3 and 4, each burner 5*a*,5*b* is an assembly 23 comprising a burner conduit 25 having one or more outlet ports 26. The burner conduit 25 has an inlet end 27 and a closed end 28. The burner conduit's inlet end 27 is fitted has a circumferential groove fitted with an O-ring 29 for sealing connection to its respective waste gas feed line 4*a*,4*b*, the connection being detailed below. The upwardly directed nozzles 15 connect to the outlet ports 26 and extend upwardly.

As shown in FIG. 3, two pairs of ports are formed in the wall of the burner shell, one pair 30,31 for supporting each burner assembly 23. The first and second ports 30,31 of a pair are located axially inline and on opposing sides of the burner shell 20. The first port 30 is formed of a machined first nipple 32 mounted to the burner shell 20.

The second port 31 is formed of a second nipple 33 mounted opposing the first nipple 32 so that their axes align. Nipples 32,33 are threaded outboard of their connection to shell 20.

The burner conduit 25 is positioned in the burner shell 20 and is sandwiched between cap 35 and first nipple 32.

As shown in FIG. 4, first nipple 32 provides a threaded connection to the feed lines 4*a*,4*b* of FIG. 1 and forms an inner cylindrical bore or inlet socket 36 for accepting the conduit's inlet end 27.

End cap 35 is threaded onto the second nipple 33 which advances a spacer fitting 40 onto the conduit's closed end 28, driving the inlet end 27 and o-ring seal 29 into the complementary inlet socket 36 of the first nipple 32. The socket 36 is formed with an internal shoulder 41 for forming a stop, limiting the insertion depth of the inlet end 27.

The spacer fitting 40 comprises several parts, one of which is an adjustable nipple 42 for manipulating axial length so that, when sandwiched, the burner conduit 25 is positively inserted and sealed within the inlet socket 36. An optional annular stabilizer ring 45 (only shown in FIG. 4) aids centering fitting 40 in second nipple 33.

In other words, end cap 35 drives the spacer fitting 40 onto closed end 28 of the burner conduit 25 which, in turn, drives the conduit's inlet end 27 into the socket 36 and against its shoulder 41, sandwiching the conduit therebetween for support and for ensuring sealed operation.

When one burner 5*a* needs to be removed for servicing or modification, then valve 6*a* for the feed line 4*a* to that burner 5*a* is closed while valve 6*b* for the other feed line 4*b* continues to remain open for continued combustion of waste gas. A secondary bypass line 46 and valve 47 are generally provided to permit process upset high-volume release of waste gas directly into a port 48 in the stack's upper portion 8*b* (FIG. 1).

The access door 22 to the burner service port 21 is opened and the end cap 35 is removed. Access is therefore provided to the spacer fitting 40 and it is removed from the closed end 28 of the burner conduit 25.

A service technician reaches in through the service port 21 to axially slide the burner conduit's inlet end 27 out of the inlet socket 36. The closed end 28 of the burner conduit 25 can be moved temporarily into port 31 and nipple 33 so as to permit the conduit's inlet end 27 to be axially extracted from inlet socket 36.

Figure 5:
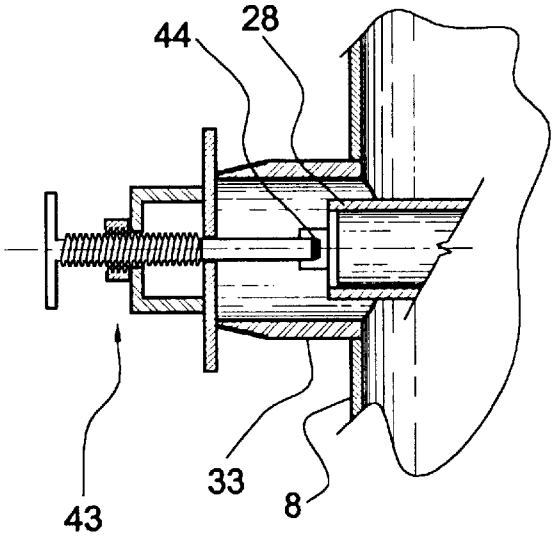
FIG. 5 is a partial cross-sectional side view of an optional pulling operation for a stubborn burner conduit.

As shown in FIG. 5, if seal of the O-ring 29 in the socket 36 is too tight or debris has jammed the inlet end 27, then a puller 43 can be utilized. A half-coupling 44 is conveniently mounted to the burner conduit's closed end 28 for engaging the puller 44 and facilitating removal of the burner conduit 25.

Once the burner conduit 25 is loosened and released axially from the inlet socket 36, the burner conduit 25 is manipulated downwardly, shown as stages A,B,C in FIG. 2, for removal through the service port 21. FIG. 3 illustrates a plan view of an intermediate stage of burner conduit removal.

While the burner conduit 25 is being removed, Ocombustion continues and air continues to flow into the stack 8 from the vents 12 and annular spaces 9. The environment beside or below the burners 5*a*,5*b* is relatively cool due to the in-rushing combustion air making in-operation replacement of a burner possible.

Replacement of a cleaned or modified burner 5*a* is in the reverse order. Simply, the service technician reinserts the burner conduit 25 into the stack through the port 21 and places the inlet end 27 into the inlet socket 36. The closure fitting 35 is placed over the conduit's closed end 28 and the closure cap 35 is tightened, driving the conduit's inlet end 27 and O-ring 29 into sealing engagement with the inlet socket 36.

If the length of a replacement burner conduit 25 is slightly different than the removed serviced conduit, then the spacer fitting adjustment nipple 42 is lengthened or shortened accordingly so that the action of the closure of the cap 35 properly sandwiches the replacement burner conduit 25 between the first nipple 32 and end cap 35.

The Auxiliary Burners

Figure 6:
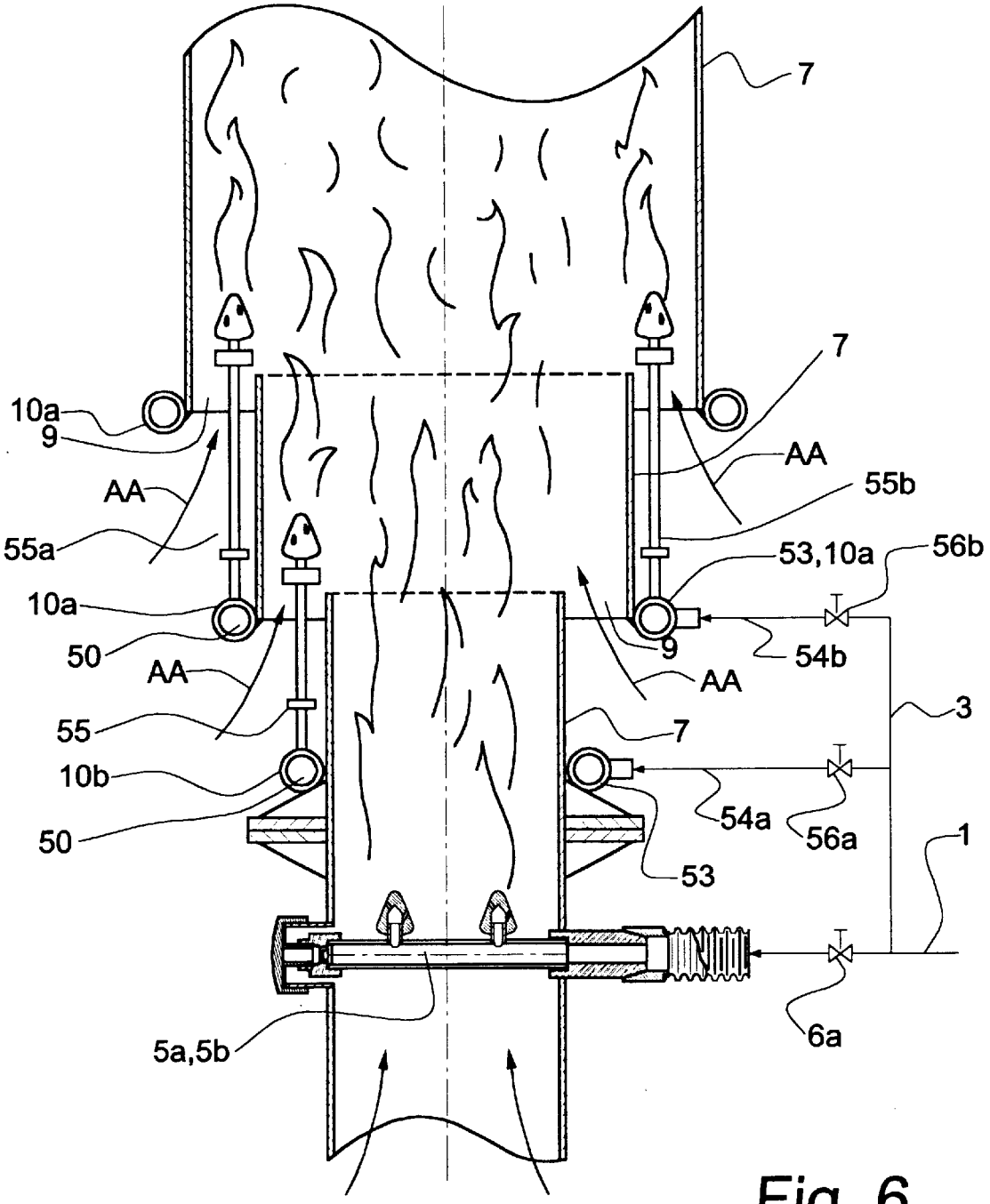
FIG. 6 is a partial side cross-sectional view of another embodiment illustrating supplemental burners fitted to successively higher shells. Waste gas conduit and flow is again shown in a schematic form.

Having reference to FIG. 6, another embodiment is shown in which additional advantage is gained due to the increased availability of additional combustion air flowing in through the annular spaces 9. One or more auxiliary burners 55,55*a*, 55*b*, which can be of conventional design, are positioned in the stack's upper portion 8*b* for incineration of even more waste gas from the gas conduit 1. Annular air AA, as referenced and illustrated on FIG. 6, flows in through the annular spaces 9. As stated above, this additional annular air AA acts as secondary combustion air for burners 5*a*,5*b*, but in practice, so much air is entrained that it can also act as primary combustion air for the auxiliary burners 55,55*a*,55*b*.

An auxiliary burner 55 can be added at each shell 7 and at least above an annular space 9 so as to be provided with primary annular combustion air AA entering therethrough.

A plurality of auxiliary burners 55*a*,55*b* are fed from a header 53. The hoop 10*a* is formed with a bore 50. Accordingly, the hoops 10*a* can conveniently form the header 53, the bore 50 being of sufficient internal diameter to distribute and supply the necessary volumetric flow to the auxiliary burners 55,55*a*,55*b*. The header 53 can be located at the lower edge 10 (at 10*a*) of each shell for also aiding in air flow, or can be located elsewhere (at 10*b*) for serving only as header 53. More particularly, the gas conduit 1 is also fed to auxiliary burner 55 and header 53 through a feed lines 54*a*,54*b*. Corresponding valves 56*a* and 56*b* enable selective use of one or more of the auxiliary burners 55 or 55*a* and 55*b*.

Using the flare stack of the present invention, high volumes of waste can be cleanly incinerated having temperatures in the burn chamber of about 1100° C. while the incorporation of large additional volumes of annular air contribute to increased dispersion and achieve same with stack surface temperatures which are typically at temperature of less than 250° C.

Dispersion

As stated above, the additional air entrained through the annular spaces 9 aids significantly in dispersion. Increased dispersion is highly desirable in reducing ground level concentration—a factor in meeting air quality regulations. One of the non-atmospheric factors for affecting the dispersion is the effective height of the stack. Conventional flare stacks use their great physical height to effect dispersion. Another physical stack design factor, other than stack height, which impacts on the effective stack height includes exhaust momentum. An increase in the volume of exhaust gases exiting the stack increases its velocity, its momentum, its maximum ascent and thus further dilutes the exhaust's concentration in the atmosphere, minimizing the ground level concentration and thereby better achieving applicable environmental guidelines. A ground-flare incinerator is particularly well served by implementing apparatus for improved dispersion as its lacks the greatest possible contributor to dispersion—physical height. The stacked shells of the present invention improve the effective stack height through providing a marked increase in exhaust volume. Tests performed using a flare similar to that of FIG. 1 have demonstrated volumetric increases in the exhaust gases of 2–3.5 times that generated from combustion alone.

The Embodiments of the invention for which an exclusive property or privilege is claimed are defined as follows:

1. A ground flare stack for incinerating waste gases, the stack having a lower tubular portion and an upper tubular exhaust portion, comprising:

(a) a tubular burn chamber located intermediate the lower and upper portions and having combustion air intakes located below the burn chamber, (b) one or more pairs of waste gas inlet ports and closure ports, the inlet and closure port of each pair being located on opposing sides of the burn chamber, (c) a service access port located in the stack at an elevation equal to or below the waste gas inlet ports;

(d) one or more primary burner assemblies fitted within the burn chamber between the inlet and closure ports, the burner assemblies accepting waste gases from the inlet port and discharging waste gases into the burn chamber for mixing with the combustion air for creating exhaust gases; and (e) the tubular exhaust stack having one or more axially displaced tubular exhaust shells, each upwardly adjacent exhaust shell having a greater diameter than the preceding exhaust shell, the exhaust shells forming a contiguous bore and being concentrically spaced for forming one or more annular inlets for admitting additional annular air into the stack for discharge with the exhaust gases.

2. The ground flare stack as recited in claim 1 wherein the annular inlets admit sufficient additional annular air for improved dispersion of the exhaust gases into the atmosphere.

3. The ground flare stack as recited in claim 1 further comprising one or more auxiliary burners fitted within the tubular exhaust stack above at least one of the one or more annular inlets, the annular inlets admitting additional annular air as primary combustion air for the one or more auxiliary burners to the stack.

4. The ground flare stack as recited in claim 2 wherein each axially displaced tubular exhaust shell has a lower edge at the annular inlet which is fitted with a bell-mouth intake so as to result in an improved intake of additional annular air.

5. The ground flare stack as recited in claim 4 wherein the bell mouth intake comprises a hoop of a circular cross-section.

6. The ground flare stack as recited in claim 5 wherein the two or more auxiliary burners are fed waste gas from a header.

7. The ground flare stack as recited in claim 6 wherein hoop is tubular and has a bore so that the hoop's bore forms the header.

* * * * *